US007278663B2

(12) United States Patent
Witchey

(10) Patent No.: US 7,278,663 B2
(45) Date of Patent: Oct. 9, 2007

(54) CARGO DOOR LOCK

(76) Inventor: Bryan Witchey, 209 Fairway Cir., Cross Junction, VA (US) 22625

( * ) Notice: Subject to any disclaimer, the term of this patent is extended or adjusted under 35 U.S.C. 154(b) by 0 days.

(21) Appl. No.: 10/986,028

(22) Filed: Nov. 12, 2004

(65) Prior Publication Data

US 2005/0099018 A1 May 12, 2005

Related U.S. Application Data

(60) Provisional application No. 60/519,548, filed on Nov. 12, 2003.

(51) Int. Cl.
*E05C 19/18* (2006.01)

(52) U.S. Cl. ..... 292/259 R; 70/14; 70/209; 70/56

(58) Field of Classification Search ..... 292/259 R, 292/258, 338, 289, 292; 70/208, 209 X, 70/14 X, 18, 19, 212, 238, 52, 55, 56 X, 70/198–200
See application file for complete search history.

(56) References Cited

U.S. PATENT DOCUMENTS 1,561,018 A * 11/1925 Peelle ..... 292/177
2,514,738 A 7/1950 Bradley
3,245,239 A 4/1966 Zaidener
4,075,879 A * 2/1978 Christopher ..... 70/337
4,372,136 A * 2/1983 Mickelson ..... 70/14
4,977,974 A 12/1990 Brown
5,145,222 A * 9/1992 Meyer ..... 292/258
5,419,165 A * 5/1995 Perkins ..... 70/14
5,775,747 A 7/1998 Navarsky
5,953,940 A * 9/1999 Ling ..... 70/25
5,975,595 A 11/1999 Lorenzo
6,065,314 A 5/2000 Nicholson
6,233,984 B1 5/2001 Blehi, III
6,494,064 B1 * 12/2002 Pena ..... 70/56
6,553,797 B2 4/2003 Witchey
6,591,641 B1 7/2003 Cann
D481,614 S * 11/2003 Onel ..... D8/331
6,834,896 B2 * 12/2004 Smith ..... 292/259 R

OTHER PUBLICATIONS

"Adjustable Lock", Transport Security, Inc.—Adjustable Trailer Door Locks, website: http://www.transportsecurity.com/adjust.htm, 1 page.
"Container Locking Device", Inland Valley Products, website: http://www.inlandvalleyproducts.com/ShedlockFrame1Source1.htm, 1 page.
"Adjustable Lock Bars", Team Logisitics, website: http://www.teamlogisticscorp.com/hookum.htm, 2 pages.
"Longhorn Lock", Land & Sea Equipment Corporation, website: http://www.laseaco.com/lock.htm, 1 page.
"Seals and Locks", Maritime Security, website: http://www.marinelog.com/DOCS/PRINTMMII/MMIIaug1.html, 2 pages.

* cited by examiner

*Primary Examiner*—Brian E. Glessner
*Assistant Examiner*—Mark Williams
(74) *Attorney, Agent, or Firm*—Christopher Wood; Wood & Eisenberg, PLLC

(57) ABSTRACT

A cargo door lock for securing the rear doors of containers such as the rear doors of a tractor-trailer container, a sea-rail container, or a static container. The cargo door lock attaches to vertical rods to prevent unauthorized opening of the container rear doors. The cargo door lock includes an extendable shaft with first and second opposite ends, first and second securing hooks that are respectively attached to the first and second opposite ends, and a lock mechanism. The lock mechanism is set at a perpendicular angle with respect to the first and second securing hooks.

21 Claims, 11 Drawing Sheets

CARGO DOOR LOCK

CROSS-REFERENCE TO RELATED APPLICATIONS

This application claims the benefit of priority from U.S. Provisional Patent Application Ser. No. 60/519,548, filed Nov. 12, 2003, the entire contents of which are incorporated herein by reference.

STATEMENT REGARDING FEDERALLY SPONSORED RESEARCH OR DEVELOPMENT

Not Applicable.

FIELD OF THE INVENTION

The present invention relates generally to anti-theft devices. More specifically, the invention is a cargo door lock for securing the rear doors of containers such as, but not limited to, tractor-trailer and sea-rail containers.

BACKGROUND OF THE INVENTION

The world relies on supply chains to get goods from the supplier to the customer. For example, a significant portion of manufactured goods reaches customers via supply chains that rely heavily on sea-rail containers and tractor-trailer containers. Such containers are vulnerable to cargo theft, e.g., theft of merchandise that is in transit in containers when stolen. Theft of merchandise from containers can occur anywhere along the supply chain including at seaports, railroad terminals, truck terminals, and truck stops.

Theft of merchandize from cargo containers causes insurance losses and a considerable amount of disruption. To claim theft insurance requires filing an insurance claim and reporting the theft to the relevant authorities. Preparing and filing paperwork uses personnel resources and causes disruption in the otherwise smooth transport of merchandise in cargo containers.

Many of these containers have rear doors fitted with a pair of vertical rods used to secure the rear doors. The containers may also be used in a static role; for example, a tractor-trailer type of container is sometimes used on construction sites to store building materials. Theft from static containers is also a problem.

U.S. Pat. No. 5,145,222 issued Sep. 8, 1992 to Meyer, describes a clamp formed of mating, telescoping hollow tubular member supports with identical L shaped hooks. The hooks encircle the vertical door rods and secure the doors of a container. The tubular members join and lock by a key operated removable cylinder in selected and aligned holes in the tubular members. The lock in the Meyer '222 patent is exposed to the elements. Rainwater can get into the lock.

Thus, there is a need robust devices that help prevent theft of merchandize from cargo containers whether the cargo container is used to transport goods or is used in a static mode to store goods such as, but not limited to, building materials.

SUMMARY OF THE INVENTION

A cargo door lock for securing the rear doors of containers such as the rear doors of tractor-trailer and sea-rail containers. The cargo door lock attaches to vertical rods to prevent unauthorized opening of the container rear doors. The cargo door lock comprises an extendable shaft with first and second opposite ends, first and second securing hooks that are respectively attached to the first and second opposite ends, and a lock mechanism. The lock mechanism is set at a perpendicular angle with respect to the first and second securing hooks.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an anti-theft device. More specifically, the invention is a cargo door lock for securing the rear doors of containers such as, but not limited to, tractor-trailer and sea-rail containers.

All references in the detailed description and claims section to "tractor-trailer containers" and/or "sea-rail containers" should be explicitly interpreted as covering any kind of container with rear doors fitted with a pair of vertical rods, which are used to secure the rear doors of the container. Thus, the term "container" as used hereinafter is intended to cover tractor-trailer containers, sea-rail containers, and static containers with rear doors that are secured using vertical rods.

The cargo door lock of the present invention is indicated generally by the numeral 100.

Figure 1A:
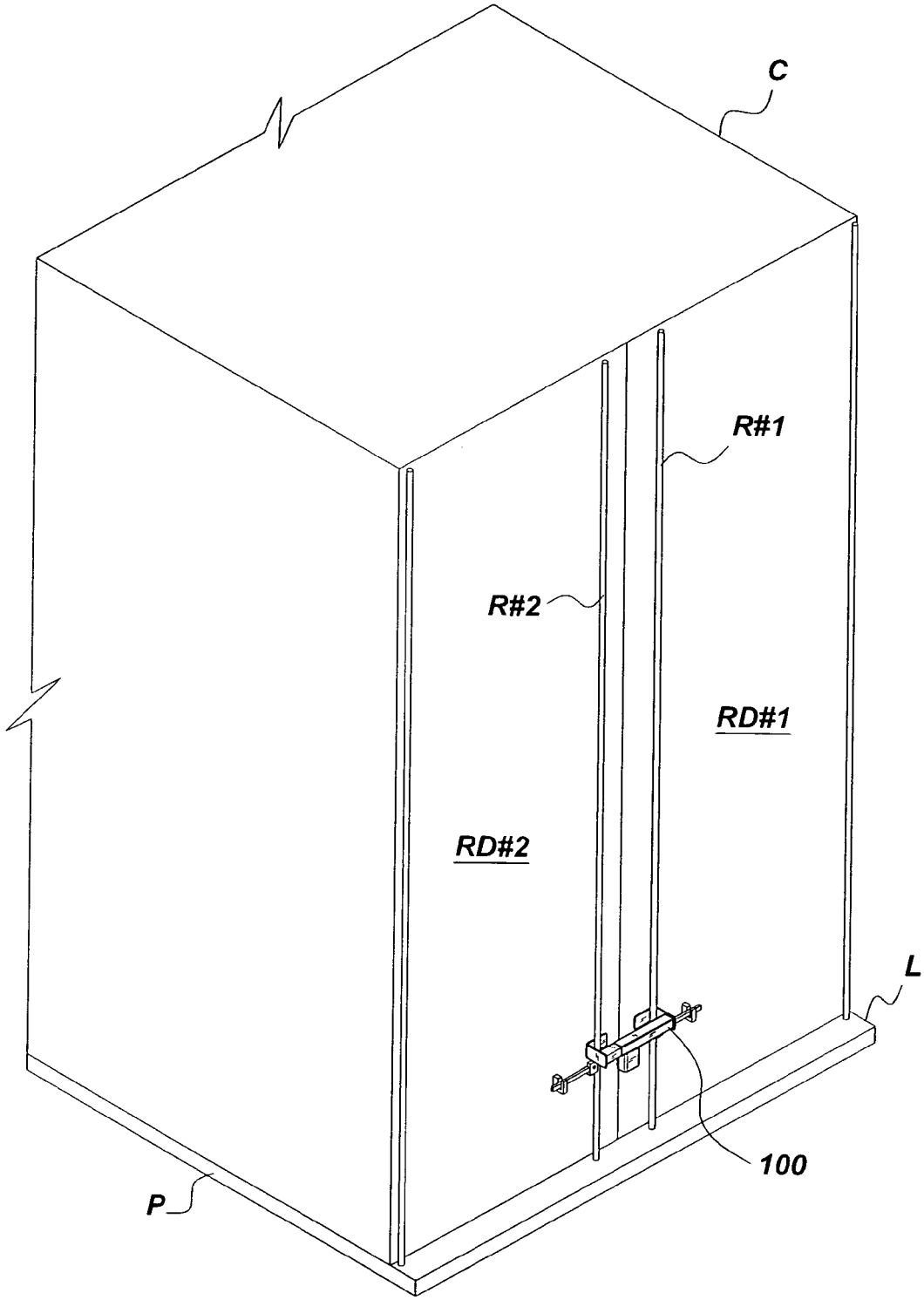
FIG. 1A shows an environmental perspective view of a cargo door lock according to the present invention.
Figure 1B:
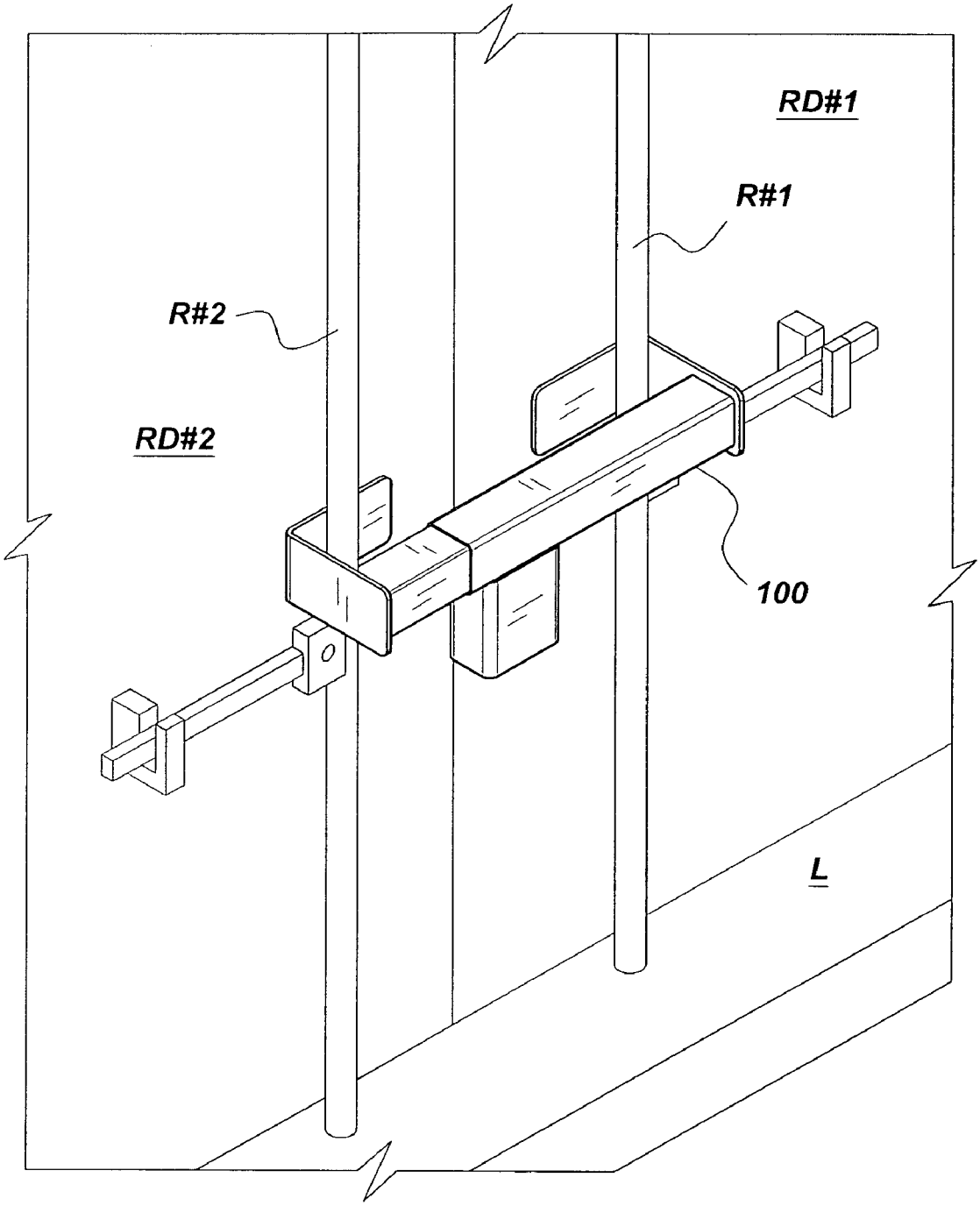
FIG. 1B is a close up view of the cargo door lock of FIG. 1A.

FIGS. 1A and 1B show a perspective environmental view of cargo door lock 100 according to the invention. The cargo door lock 100 is shown fastened to the back of a cargo container C; more specifically, cargo door lock 100 is attached to substantially vertical rods R#1 and R#2; rods R#1 and R#2 are used to open and close the container's rear doors RD1 and RD2. In normal use, the cargo door lock 100 is fastened to the vertical rods R#1 and R#2 to prevent unauthorized use of the vertical rods thereby helping to prevent unauthorized access to the interior of container C.

When the container is carried on a tractor-trailer, the rear of the container C is often not flush with respect to the truck bed or platform P used to hold the container C; a lip L often results. Regardless of the base or ground on which container C sits, the device 100 is designed to make it hard for a would be thief to get access to the lock mechanism 130; specifically, the lock mechanism 130 points downwards in normal use, as shown in FIGS. 1A and 1B, such that an operator (e.g., a truck driver) can attach device 100 to the rods R#1 and R#2 close to the lip L thereby making it harder for a would be thief to get lock wrecking tools into, for example, the lock housing 135 (see, e.g., FIGS. 4, 5A and 6A).

Figure 2A:
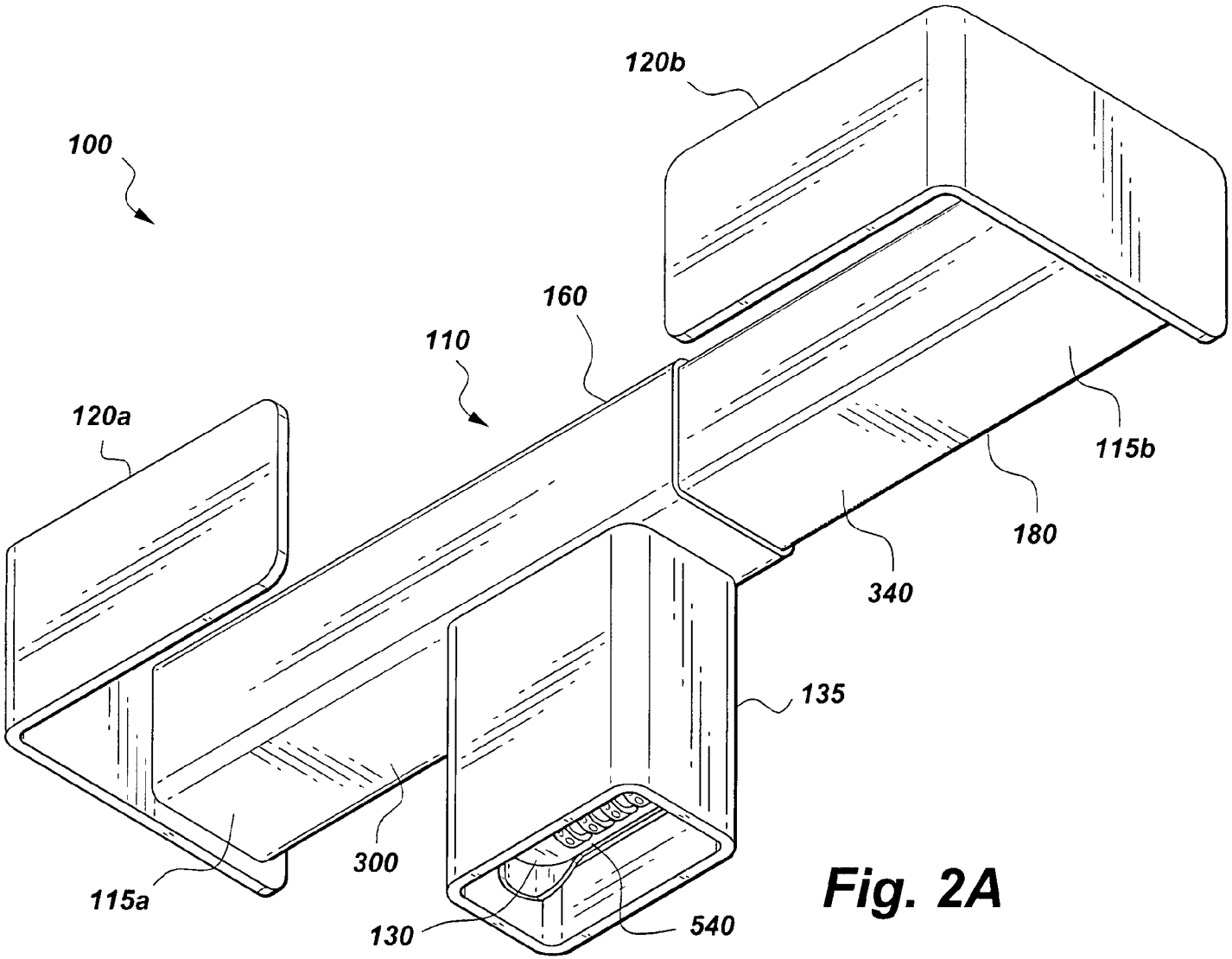
FIG. 2A is a perspective view of a cargo door lock fitted with a combination lock according to the present invention.

Referring to FIG. 2A, the cargo door lock 100 comprises an extendable shaft 110 with a first 115*a* and second 115*b* opposite ends, first 120*a* and second 120*b* vertical rod securing hooks attached respectively to first and second opposite ends 115*a* and 115*b*, and a lock mechanism 130 located inside lock housing 135. The rod securing hooks 120*a* and 120*b* face inward with respect to each other and inward from shaft ends 115*a* and 115*b*, respectively.

Figure 3:
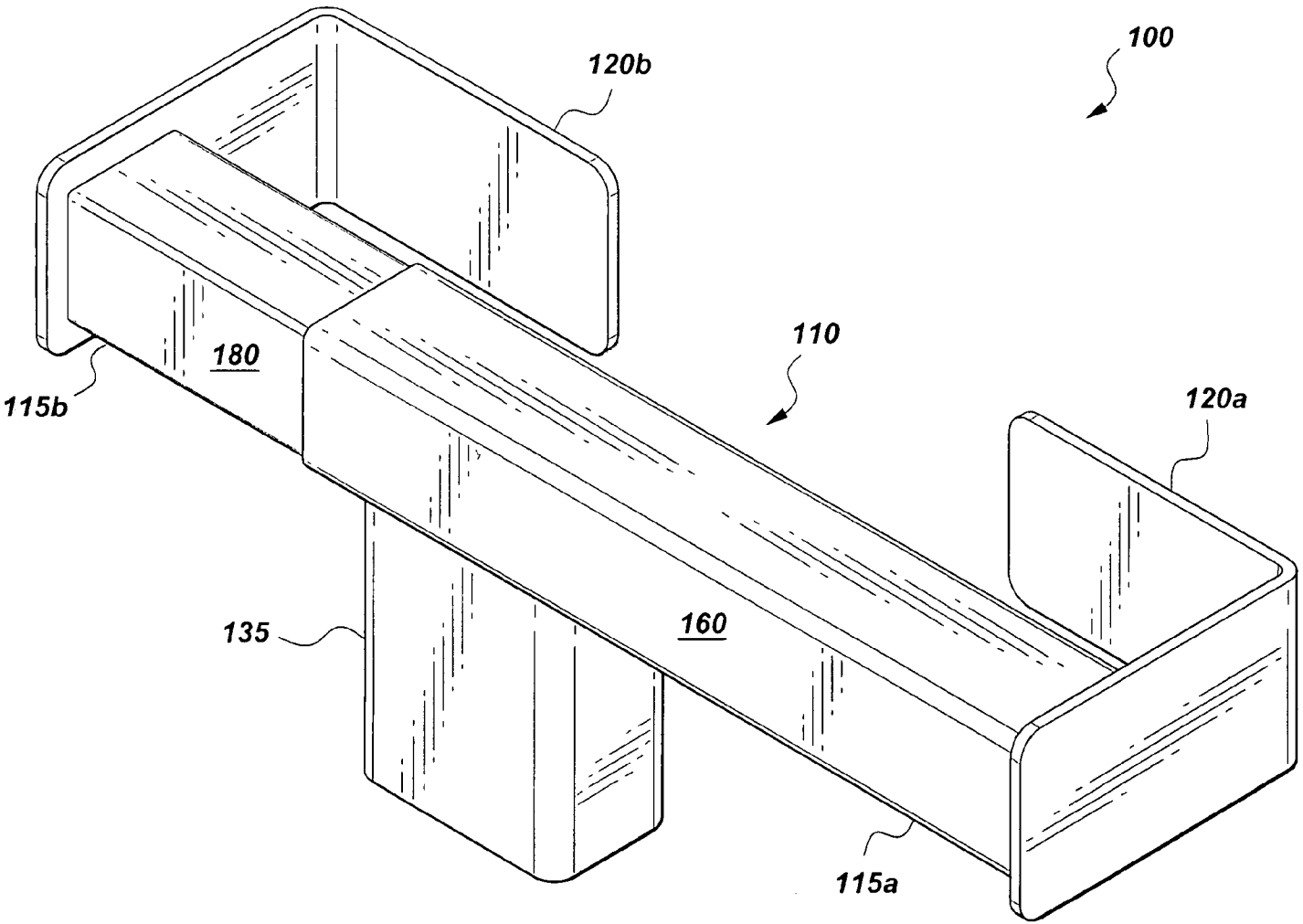
FIG. 3 shows another perspective view the cargo door lock shown in FIG. 2A.

Still referring to FIG. 2A, the lock mechanism 130 and housing 135 is set at a perpendicular angle with respect to first and second hooks 120*a* and 120*b* such that the lock mechanism 130 faces downward with respect to the hooks 120*a* and 120*b*; the perpendicular relationship between the lock mechanism 130 (and by default the lock mechanism housing 135) and the hooks 120*a* and 120*b* is also seen in FIG. 3. By placing the lock mechanism 130 inside a housing 135 which points downward with respect to the hooks 120*a* and 120*b*, the lock mechanism 130 is less exposed to poor weather conditions than the lock mechanism as described in U.S. Pat. No. 5,145,222 issued Sep. 8, 1992 to Meyer, wherein the lock mechanism in the Meyer '222 patent is in the same horizontal plane as the end hooks thus leaving the lock mechanism exposed to poor weather conditions. As described below, the lock mechanism 130 of the present invention reversibly locks the extendable shaft 110 at a predetermined length.

Figure 2B:
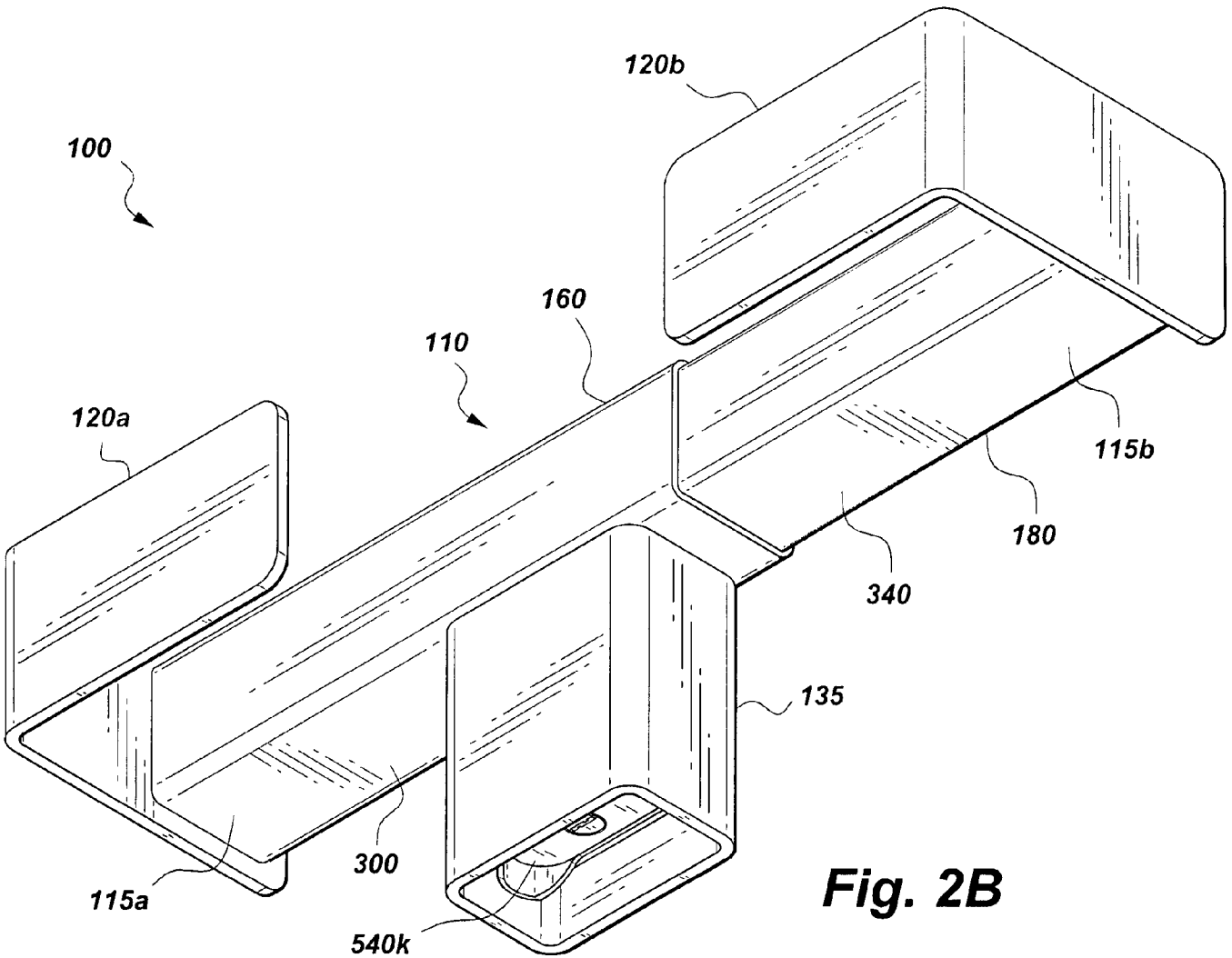
FIG. 2B is a perspective view of a cargo door lock fitted with a key operated lock according to the present invention.

It should be understood that while the lock mechanism 130 shown in FIG. 2A comprises a combination lock 540, the invention is not restricted to a particular kind of lock. For example, FIG. 2B shows a perspective view of a cargo door lock of FIG. 2A, but fitted with a key operated lock 540*k* in place of the combination lock 540.

Rod securing hooks 120*a* and 120*b* and lock housing 135 are preferably welded to the extendable shaft 110, thus making for a very durable cargo door lock 100; however, any suitable securing means may be substituted for welds such as securing bolts which may be used in place of welds to attach hooks 120*a*, 120*b* and housing 135 to the extendable shaft 110.

Figure 4:
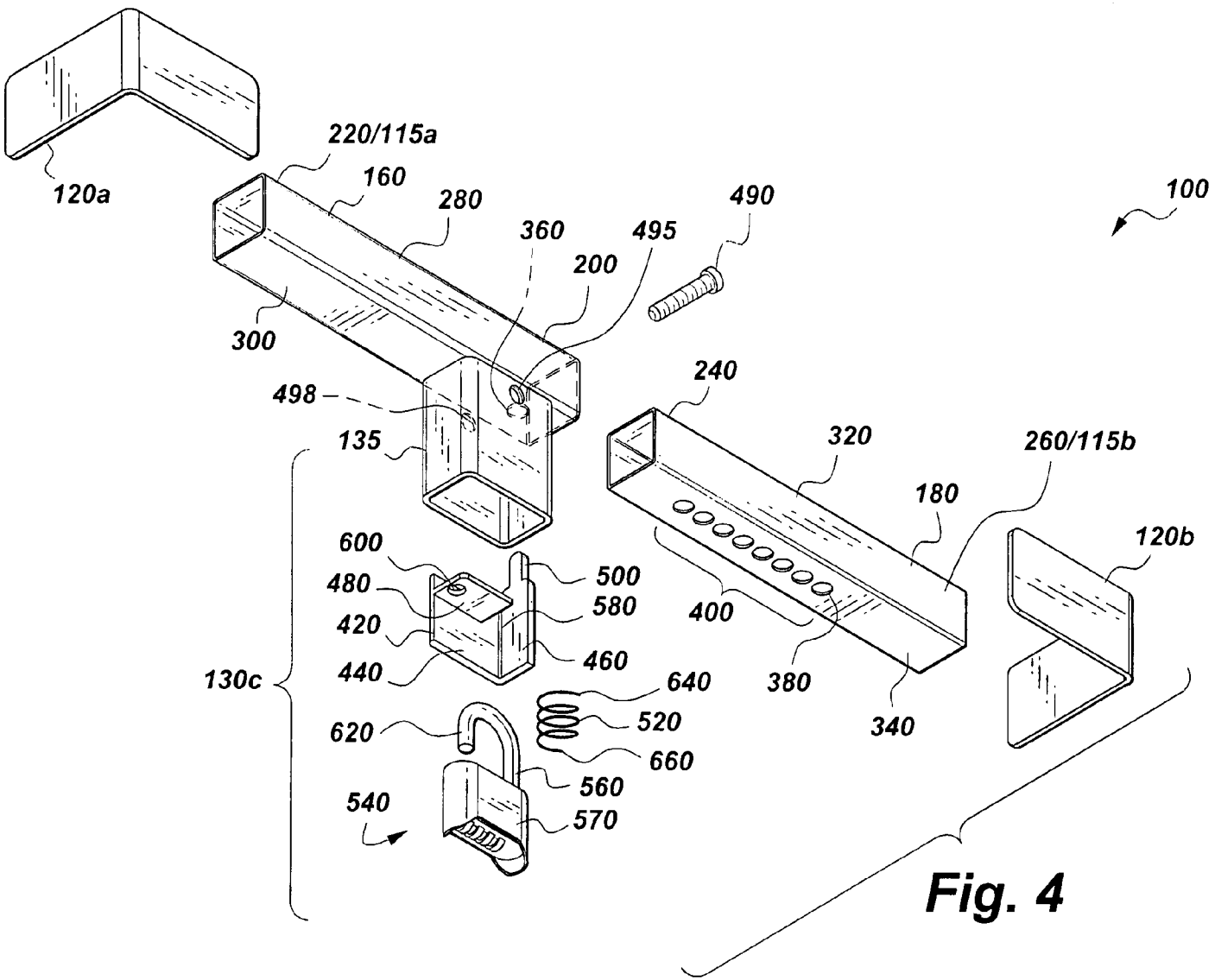
FIG. 4 is an exploded view of the cargo door lock of FIG. 2A.

Referring to FIG. 4 in particular, extendable shaft 110 comprises first 160 and second 180 shaft members. First shaft member 160 has proximal 200 and distal 220 opposite ends, and second shaft member 180 has proximal 240 and distal 260 opposite ends. Proximal 200 and distal 220 opposite ends define first middle portion 280 and first bottom wall 300; proximal 240 and distal 260 opposite ends define second middle portion 320 and second bottom wall 340. Proximal end 240 of second shaft member 180 fits telescopically inside proximal end 200 of first shaft member 160 to provide extendable shaft 110, wherein the opposite ends 115*a* and 115*b* of the extendable shaft 110 are in fact the distal ends 220 and 260 respectively of first 160 and second 180 shaft members.

Still referring to FIG. 4, first bottom wall 300 of first shaft member 160 comprises first hole 360; second bottom wall 340 of second shaft member 180 has a plurality of holes 380 arranged in a row 400 such that when the second shaft member 180 is moved telescopically inside the first shaft member 160, first hole 360 aligns in turn with each hole in the row of holes 400 in second bottom wall 340 of second shaft member 180.

Still referring to FIG. 4, the lock mechanism 130 can take any suitable form such as a spring-loaded combination lock mechanism 130*c*. The spring-loaded combination lock mechanism 130*c* comprises an L-shaped bracket 420 having a first 440 and second 460 sidewalls; a base plate 480 attached to one end of the first sidewall 440 to create a second L-bracket with respect to first sidewall 440, a tongue 500 protruding from one end of second sidewall 460, a spring 520, and a combination lock 540; the combination lock 540 comprises a lock hook 560 and a combination lock housing 570. The spring-loaded combination lock mechanism 130*c* is housed inside housing 135. The tongue 500 is sized and positioned to move easily into and out of first hole 360 in the bottom wall 300 of first shaft 160 and an aligned hole in the bottom wall 340, i.e., one of the holes 380 in the row of holes 400 in the bottom wall 340 of second shaft member 180.

Figure 5A:
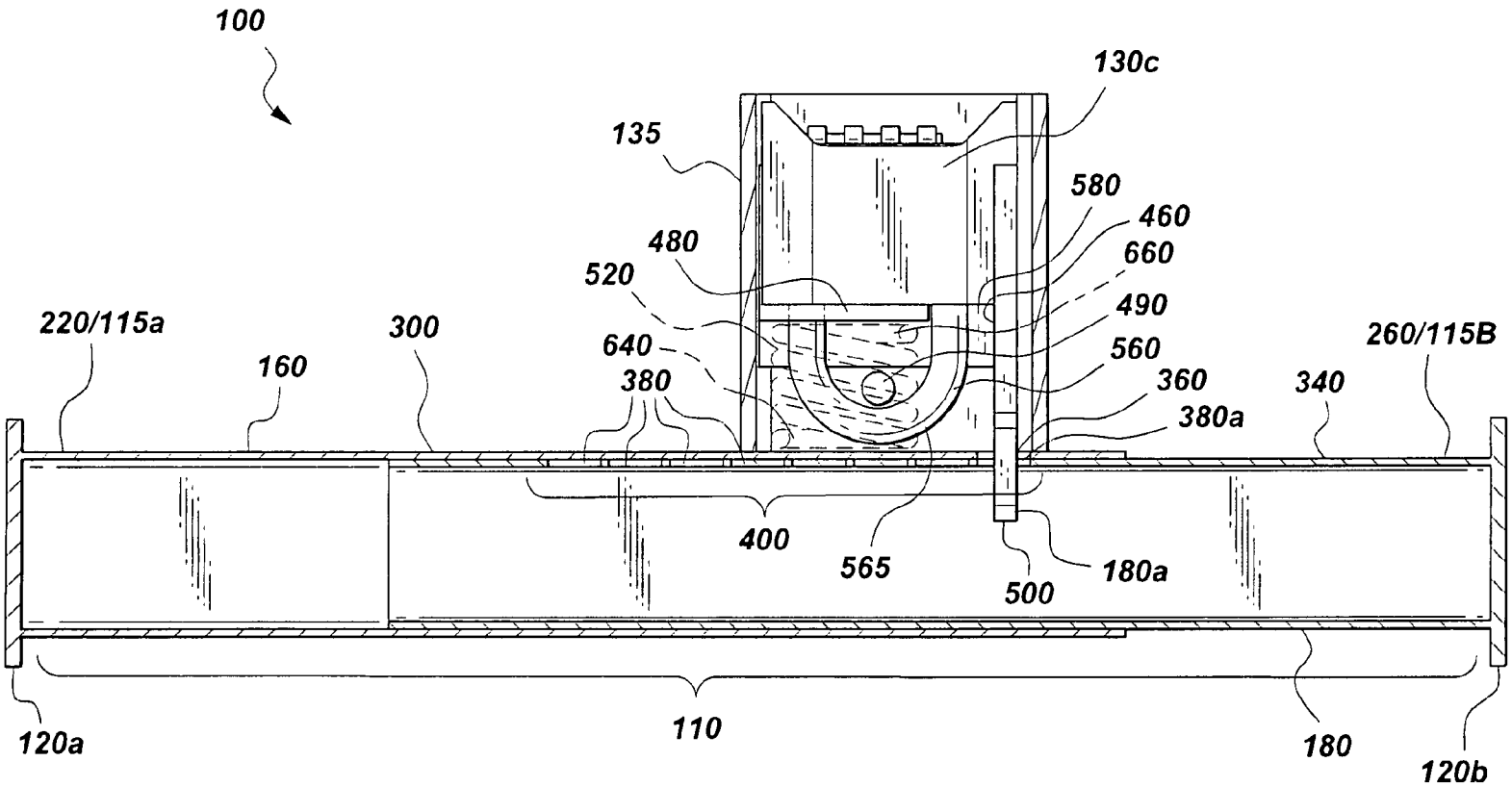
FIG. 5A is a partial cut-away side view of a cargo door lock showing one configuration of an optional spring component inside a lock mechanism according to the present invention.
Figure 5B:
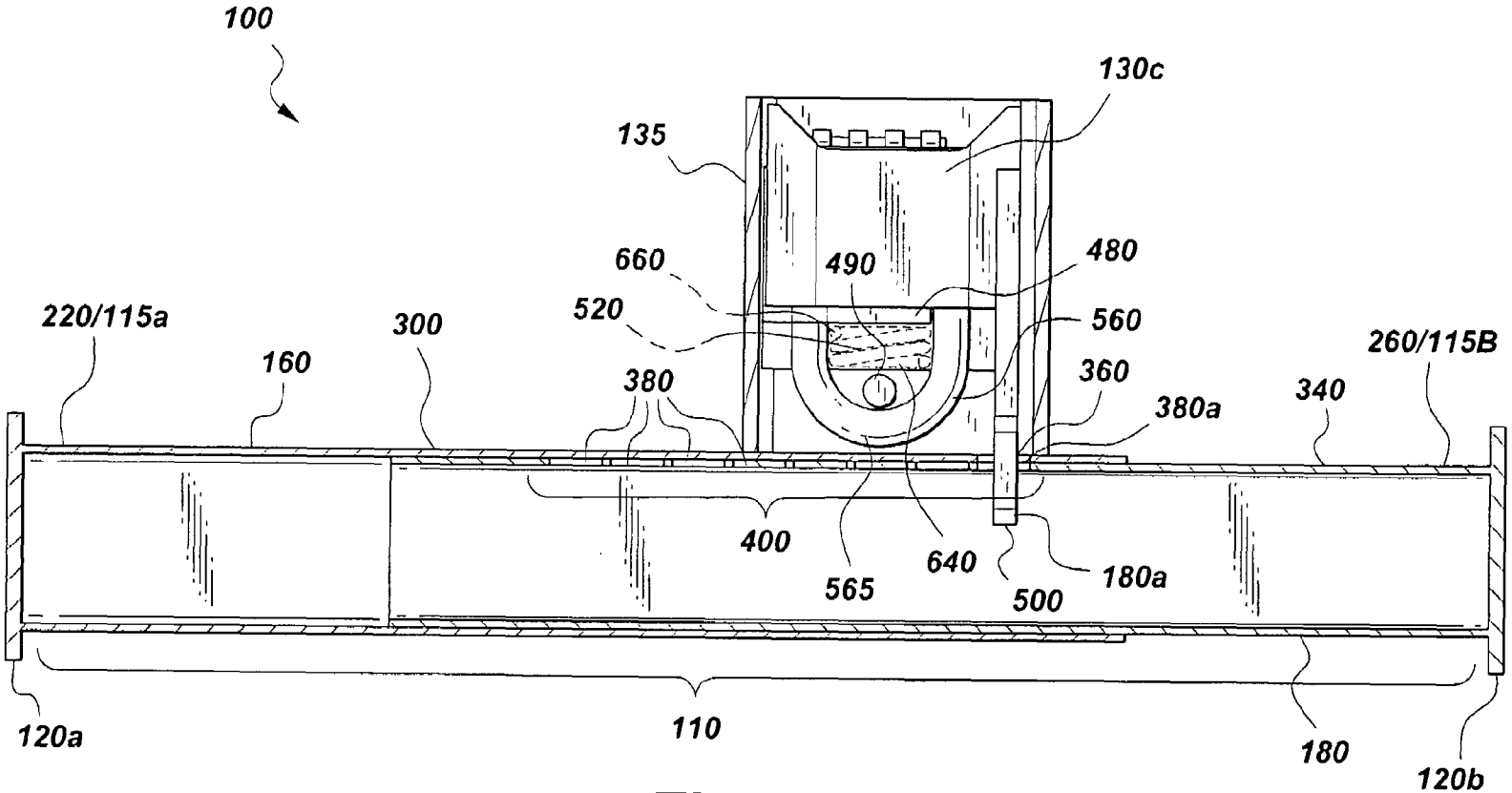
FIG. 5B is a partial cut-away side view of a cargo door lock showing another configuration of an optional spring component inside a lock mechanism according to the present invention.
Figure 6A:
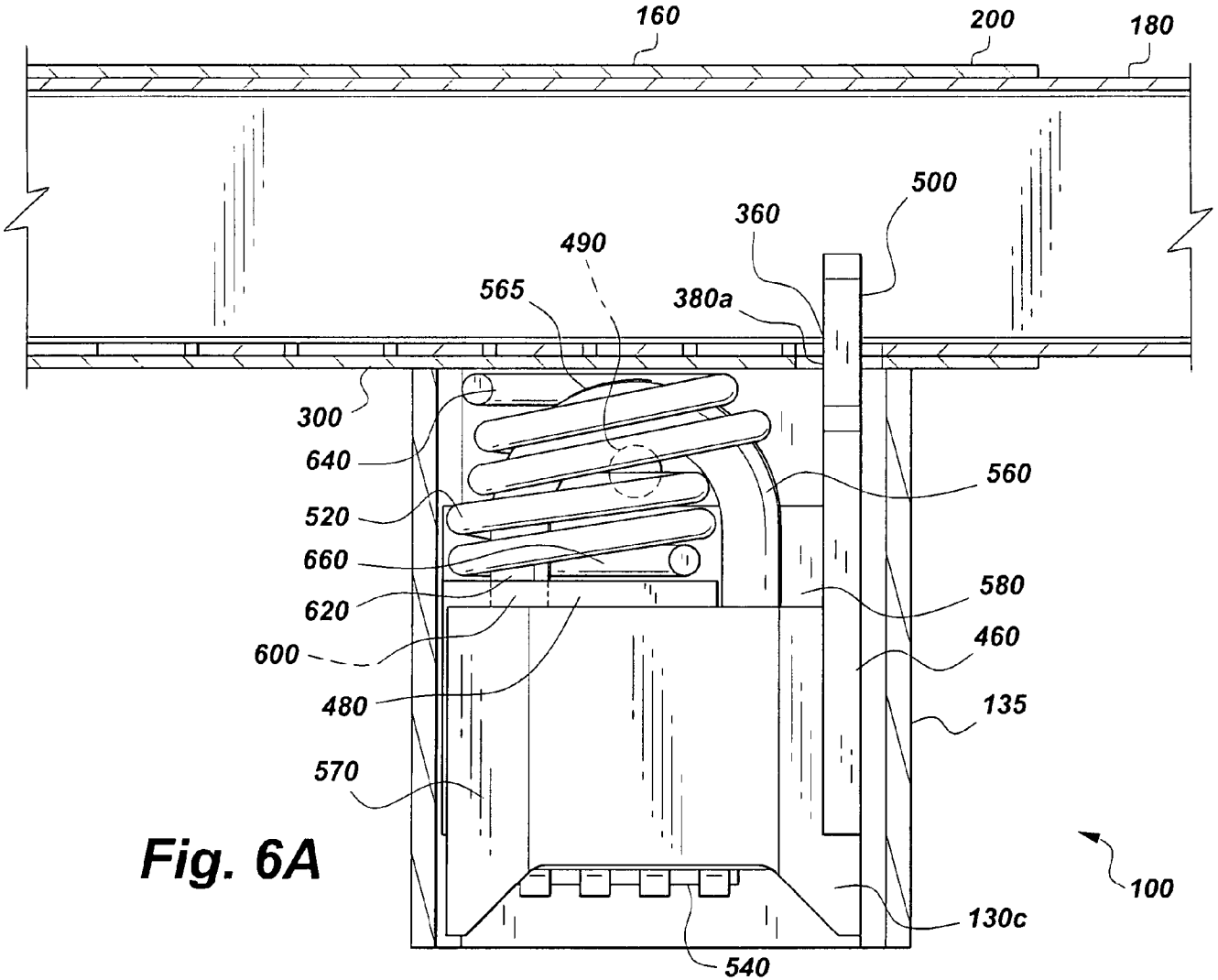
FIG. 6A is a close up view of the internal components of a spring-loaded combination lock mechanism with the optional spring component wrapped partially around a lock hook according to the present invention.

It should be noted that the spring 520 could be left out depending on the ability of the lock hook 560 to spring back into an unlocked position. It should be understood that the exact configuration and position of the spring 520 can vary with respect to the lock hook 560. The spring 520 can be intertwined with the lock hook 560 (as shown in FIGS. 5A and 6A), but preferably sits separately within the confines of the lock hook 560 (see FIGS. 5B and 6B) where spring end 660 abuts against the base-plate 480 and the other end 640 abuts against the securing member 490, thus providing additional resilient force to operate the lock mechanism 130*c*; in FIGS. 5B and 6B, the securing member 490 is located between the spring end 540 and the curve end 565 of lock hook 560.

It should also be understood that in addition to the optional spring 520, the key operated lock 540*k* (shown in FIG. 2B) can be used in place of the combination lock 540. Thus, the locking mechanism 130 may or may not comprise the spring 520, and the key operated lock 540*k* can be used in place of the combination lock 540.

The spring 520 also serves to dampen or control vibration inside the lock mechanism 130 (e.g., see 130*c* in FIG. 4). Containers and anything attached to them experience vibration while in transit, especially when carried on a tractor-trailer. Thus, the spring 520 helps to prevent undesirable vibration that would otherwise tend to cause increased wear and tear.

A gap 580 is located between the base plate 480 and the second sidewall 460 of bracket 420; the base plate 480 defines a base plate hole 600 therein. The lock hook 560 fits through the gap 580 allowing the end 620 of the lock hook 560 to fit through hole 600 in the base-plate 480. In one embodiment, at least part of the lock hook 560 fits through the spring 520; one end 640 of the spring 520 abuts against the bottom wall 300 and the other end 660 abuts against the base plate 480, thus providing additional resilient force to operate the lock mechanism 130*c*. However, the spring 520 is not absolutely necessary to operate the device 100 and may be left out particularly if, for example, the lock 540 or

540*k* has sufficient inbuilt resilient force to push out the lock hook 560. However, the spring 520 helps to control vibration within the lock mechanism 130 (such as 130*c* in FIG. 4); vibration occurs during transit of the container C particularly when the container C is carried on a tracker-trailer along bumpy roads.

The component parts of the combination lock mechanism 130*c* are housed inside housing 135; a securing member 490, such as a screw or bolt, is used to hold the combination lock 540 in situ particularly when the combination lock 540 is in an unlocked configuration upon entering the appropriate unlock code; the member 490 also prevents unauthorized removal of combination lock 540 from housing 135. The securing member 490 fits through a securing hole 495 in one side of the housing 135; an optional blind hole 498 on the other side of the housing 135 secures the securing member 490, thereby preventing unauthorized removal of the lock mechanism 130*c*.

Figure 6B:
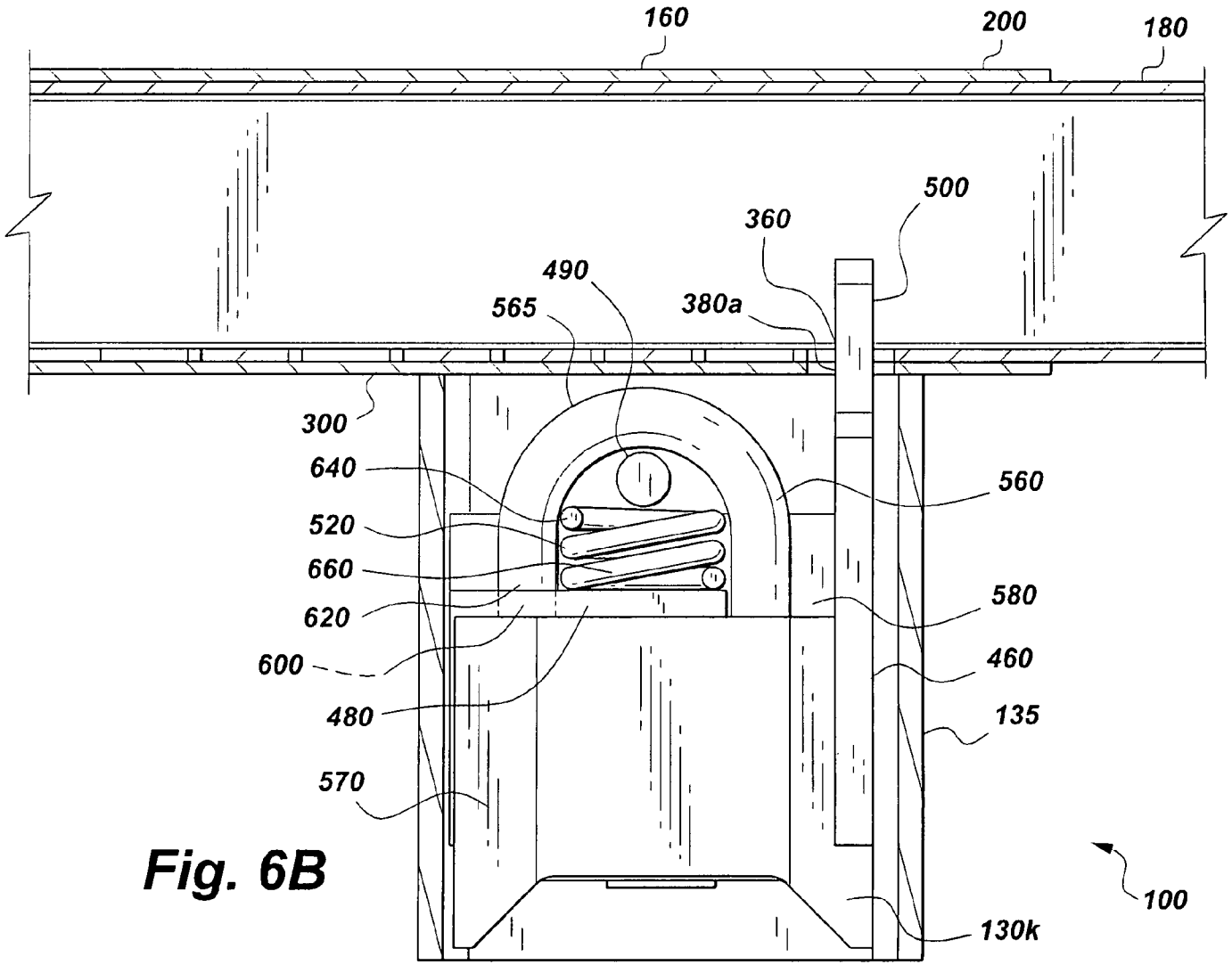
FIG. 6B is a close up view of the internal components of a spring-loaded combination lock mechanism with the optional spring component located within the confines of a lock hook according to the present invention.

In normal use the combination lock mechanism 130*c* is set by adjusting the length of extendable shaft 110 to align first hole 360 with one of the plurality of holes 380 (shown as hole 380*a* in FIGS. 5A, 5B, 6A and 6B) and thereupon pushing the combination lock 560 into the housing 135 thereby causing the combination lock housing 570 to abut up against base plate 480 and thereby force the tongue 500 into first hole 360 and thence into an aligned hole in the plurality of holes 380 in the bottom wall 340 (see FIG. 4) and thereby setting the extendable shaft 110 at a predetermined length; pushing the combination lock 560 into housing 135 also simultaneously compresses spring 520 (e.g., see FIG. 6B). The predetermined length is judged by the extension required to ensure hooks 120*a* and 120*b* are secured around vertical rods R#1 and R#2 as shown in FIGS. 1A and 1B.

It should be understood that the combination number of the combination lock 540 is optionally changeable to a new locking/unlocking combination. This feature is useful, for example, when an employee leaves or if the combination number becomes generally known. In addition, the combination lock 540 could be swapped out and replaced with a key-type lock.

Figure 7:
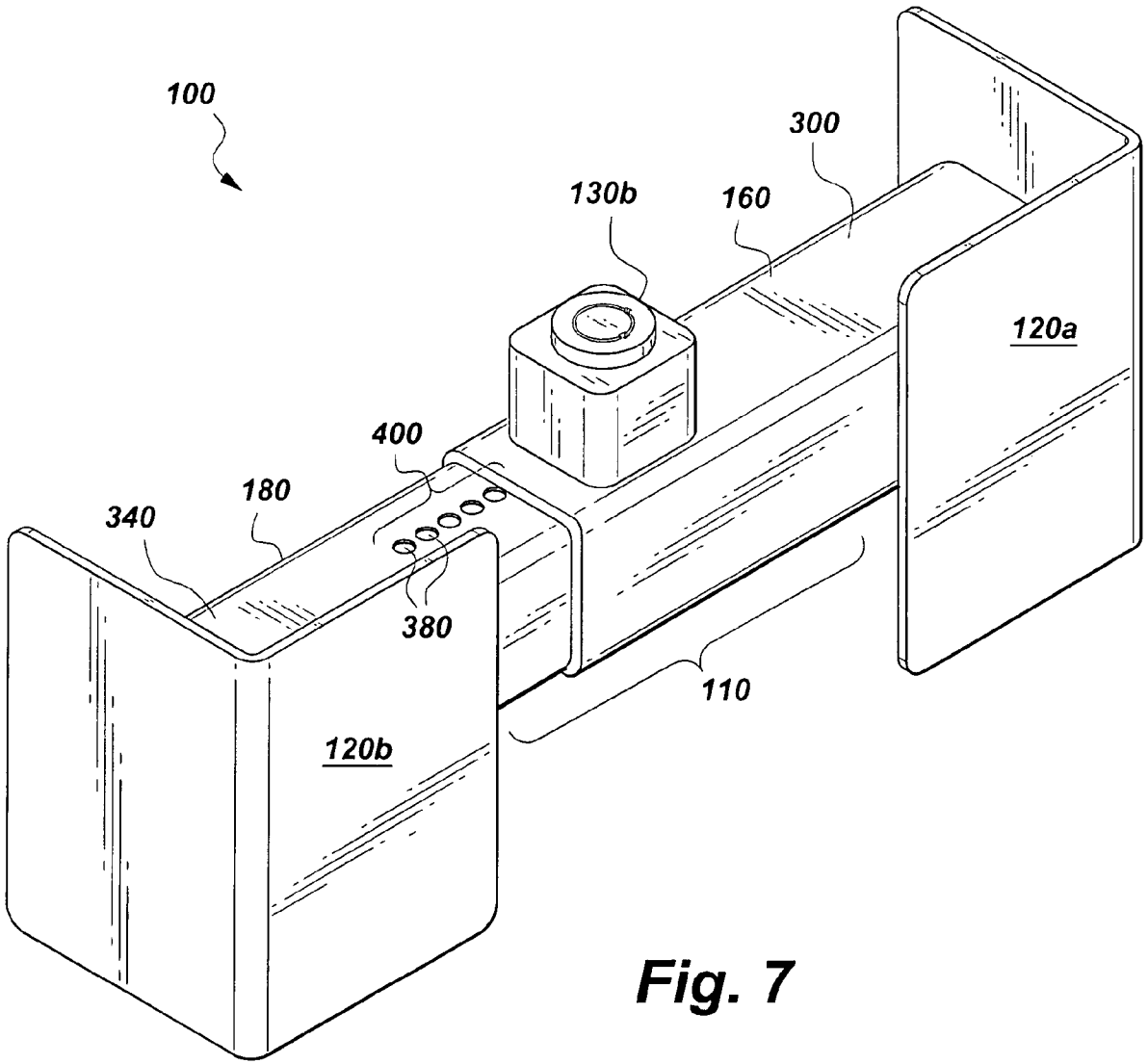
FIG. 7 shows a perspective view of a cargo door lock fitted with a key operated barrel shaped spring lock according to the present invention.

Referring to FIG. 7, the lock mechanism 130 is a locking mechanism in the form of a key operated barrel shaped spring lock 130*b*. This type of locking mechanism is well-known in the art and is described, for example, in U.S. Pat. No. 6,553,797 issued Apr. 29, 2003 to Witchey (the barrel shaped spring lock is shown as part number 26 in the '797 Witchey patent); the '797 Witchey patent is incorporated herein by reference in its entirety.

Still referring to FIG. 7, lock 130*b* comprises a pin (shown as part number 36 in the '797 Witchey patent); in the present invention the pin protrudes though hole 360 in the first shaft member 160 and an aligned hole selected from the row of holes 400 in the second shaft member 180 thereby adjusting the length of extendable shaft 110 as desired.

It is to be understood that the present invention is not limited to the embodiments described above, but encompasses any and all embodiments within the scope of the following claims.

The invention claimed is:

1. A cargo door lock for locking the rear doors of a container fitted with a pair of vertical rods used to secure the rear doors, said cargo door lock comprising:

an extendable shaft, wherein said shaft has first and second opposite ends;

a first rod securing hook and a second rod securing hook, wherein said first and second rod securing hooks are attached respectively to said first and second opposite ends of said extendable shaft, said first and second rod securing hooks are aligned in the horizontal plane;

a lock mechanism attached to said extendable shaft, wherein said lock mechanism is set in a perpendicular plane with respect to said first and second hooks, said lock mechanism reversibly locks said extendable shaft at a predetermined length, said lock mechanism further comprising:

an L-shaped bracket, said L-shaped bracket having first and second sidewalls and a base plate attached to one end of said first sidewall thereby defining a second L-bracket with respect to said first sidewall, said base plate comprising a tongue protruding from one end of said second sidewall;

a lock, said lock having a lock hook, and a spring, wherein said spring has first and second opposite ends, wherein a gap is located between said base plate and said second sidewall, further wherein said lock hook fits through said gap, and wherein said spring sits inside said lock hook; and a lock housing, wherein said lock mechanism is located inside said lock housing.

2. The cargo door lock of claim 1, wherein said first and second hooks are L-shaped hooks.

3. The cargo door lock of claim 1, wherein said lock is a spring-loaded combination lock.

4. The cargo door lock of claim 1, wherein said lock is a key operated banel shaped spring lock.

5. The cargo door lock of claim 1, wherein said lock is a key operated lock.

6. The cargo door lock of claim 1, wherein said lock mechanism has a lock hook and a spring, wherein said spring has first and second opposite ends, wherein a gap is located between said base plate and said second sidewall, further wherein said lock hook fits through said gap, and wherein said spring sits inside said lock hook.

7. The cargo door lock of claim 1, wherein said lock mechanism comprises a securing member, said securing member secures said lock mechanism in situ, said securing member fits through a securing hole in one side of said lock housing.

8. The cargo door lock of claim 1, wherein said lock mechanism comprises a securing member, said securing member secures said lock mechanism in situ, said securing member fits through a securing hole in one side of said lock housing, wherein a blind hole is located on the other side of the lock housing, said blind hole is used to secure said securing member.

9. A cargo door lock for locking the rear doors of a tractor-trailer or ship-rail container by securing a pair of vertical rods used to secure the rear doors, said cargo door lock comprising:

an extendable shaft having a first shaft member and a second shaft member, wherein said first and second shaft members each have proximal and distal opposite ends, said proximal and distal ends of said first and second shaft members respectively define first and second middle portions and first and second bottom walls, wherein said proximal end of said second shaft member fits telescopically inside said proximal end of said first shaft member, wherein said bottom wall of said first shaft member has a first hole, further wherein said bottom wall of said second shaft member has a plurality of holes arranged in a row such that when said second shaft member is moved telescopically inside said first shaft member said first hole aligns in turn with each hole in said row of holes in said bottom wall of said second shaft member;

a first securing hook and a second securing hook, wherein said first and second hooks are respectively attached to the distal ends of said first and second shaft members, wherein said first and second hooks are aligned in the horizontal plane;

a lock mechanism for locking said extendable shaft at a desired length, wherein said lock mechanism is attached to said bottom side of said first shaft member such that said lock is in a perpendicular plane respect to said first and second securing hooks, wherein said lock comprises a tongue such that said tongue can reversibly penetrate said first hole and an aligned hole selected from said plurality of holes in said second shaft to lock said extendable shaft at a desired length, said lock mechanism further comprising:

an L-shaped bracket, said L-shaped bracket having first and second sidewalls and a base plate attached to one end of said first sidewall thereby defining a second L-bracket with respect to said first sidewall, said base plate comprising a tongue protruding from one end of said second sidewall;

a lock, said lock having a lock hook, and a spring, wherein said spring has first and second opposite ends, wherein a gap is located between said base plate and said second sidewall, further wherein said lock hook fits through said gap, and wherein said spring sits inside said lock hook; and a lock housing, wherein said lock mechanism is located inside said lock housing, whereby an operator can lock the rear doors of a tractor-trailer or ship container by securing said hooks around a pair of vertical rods used to secure the rear doors.

10. The cargo door lock of claim 9, wherein said lock mechanism is a spring loaded locking mechanism.

11. The cargo door lock of claim 9, wherein said lock is a key operated baffel shaped spring lock.

12. The cargo door lock of claim 9, wherein said lock is a key operated lock.

13. The cargo door lock of claim 9, wherein said first and second hooks are L-shaped brackets, said L-shaped brackets face inward with respect to said middle portions of said extendable shaft.

14. The cargo door lock of claim 9, wherein said lock mechanism has a lock hook and a spring, wherein said spring has first and second opposite ends, wherein a gap is located between said base plate and said second sidewall, further wherein said lock hook fits through said gap, and wherein said spring sits inside said lock hook.

15. A lock mechanism comprising:

an L-shaped bracket, said L-shaped bracket having first and second sidewalls and a base plate attached to one end of said first sidewall thereby defining a second L-bracket with respect to said first sidewall, wherein a tongue protrudes from one end of said second sidewall, and wherein said base plate includes a base plate hole;

a lock, said lock having a lock hook; and a spring, wherein said spring has first and second opposite ends, wherein a gap is located between said base plate and said second sidewall, further wherein said lock hook fits through said gap, wherein said spring sits inside said lock hook, wherein said lock hook also fits through said base plate hole, wherein said lock mechanism is housed inside a housing and secured in said housing by a securing member, and wherein one end of said spring abuts against said base-plate and the other end of said spring abuts against said securing member.

16. The lock mechanism of claim 15, wherein said lock is selected from the group consisting of a combination lock and a key operated lock.

17. The lock mechanism of claim 15, wherein said lock mechanism is housed in a lock housing.

18. The lock mechanism of claim 15, wherein said lock hook includes a curve end, and said securing member is located between said spring and said curve end of said lock hook.

19. A spring-loaded combination lock mechanism comprising:

an L-shaped bracket, said L-shaped bracket having first and second sidewalls and a base plate attached to one end of said first sidewall thereby defining a second L-bracket with respect to first sidewall, wherein a tongue protrudes from one end of said second sidewall, and wherein said base plate includes a base plate hole;

a spring having opposite ends; and a combination lock, said combination lock having a lock hook and a combination lock housing, wherein a gap is located between said base plate and said second side-wall, further wherein said lock hook fits through said gap, and wherein said spring sits inside said lock hook, whereby said combination lock is housed inside a housing and secured in said housing by a securing member, wherein one end of said spring abuts against said base-plate and the other end of said spring abuts against said securing member, and wherein said lock hook also fits through said base plate hole.

20. The spring-loaded combination lock mechanism of claim 19, wherein said lock hook includes a curve end, and said securing member is located between said spring and said curve end of said lock hook.

21. The spring-loaded combination lock mechanism of claim 19, wherein instead of said spring sitting inside said lock hook at least part of said lock hook fits through said spring.

* * * * *